United States Patent [19]

Kevonian

[11] Patent Number: 4,908,606

[45] Date of Patent: Mar. 13, 1990

[54] THEFT RESISTANT SECURITY CONTAINERS USING SHOCKING WIRES AND AUDIO ALARM

[76] Inventor: Raffi Kevonian, 4960 Hollywood Blvd. #D, Los Angeles, Calif. 90027

[21] Appl. No.: 138,913

[22] Filed: Dec. 28, 1987

[51] Int. Cl.[4] ..... G08B 13/14; G08B 13/18

[52] U.S. Cl. ..... 340/571; 340/539; 340/574; 340/691

[58] Field of Search ..... 340/571, 574, 568, 539, 340/691; 150/102

[56] References Cited

U.S. PATENT DOCUMENTS

| | | | |
|---|---|---|---|
| 1,288,909 | 12/1918 | Jones | 340/691 |
| 3,851,326 | 11/1974 | Costa | 340/571 |
| 3,893,096 | 7/1975 | Tucci et al. | 150/102 |
| 4,023,138 | 5/1977 | Ballin | 340/539 |
| 4,155,079 | 5/1979 | Chiu et al. | 340/571 |
| 4,162,695 | 7/1979 | Moses | 150/102 |
| 4,272,763 | 6/1981 | Chang et al. | 340/571 |
| 4,591,835 | 5/1986 | Sharp | 340/571 |
| 4,728,937 | 3/1988 | Hsu | 340/571 |
| 4,804,943 | 2/1989 | Soleimani | 340/571 |

*Primary Examiner*—Glen R. Swann, III

*Attorney, Agent, or Firm*—James E. Brunton

[57] ABSTRACT

A container such as an attache case, handbag, suit case lock box or the like, which is automatically, electrically energized in the event of unauthorized transport or tampering, whereby an electrical shock of non-lethal, but substantial magnitude will be imparted to a person other than the owner who may be in contact with the container. In the preferred form of the invention, the security container is also provided with an audio alarm which is activated upon unauthorized movement of the container.

8 Claims, 3 Drawing Sheets

THEFT RESISTANT SECURITY CONTAINERS USING SHOCKING WIRES AND AUDIO ALARM

BACKGROUND OF THE INVENTION

1. Field of the Invention

The present invention relates generally to containers for the storage and transport of valuables. More particularly, the invention concerns containers such as attache cases, handbags, suit cases, lock boxes and the like, which are automatically, electrically energized in the event of unauthorized transport or tampering, whereby an electrical shock of nonlethal, but substantial magnitude will be imparted to a person other than the owner who may be in contact with the container. In the preferred form of the invention, the security container is also provided with an audio alarm which is activated upon unauthorized movement of the container.

2. Discussion of the Invention

Theft of containers such as attache cases, handbags and suitcases by "purse snatchers" or by thieves prowling airports, bus stations and railway stations has become increasingly common. Additionally, in recent years there has been a sharp increase in burglary of homes and offices. During such burglaries, the theft of various types of containers for valuables is common.

In the past, many devices have been devised to prevent or deter such crimes. Many existing devices rely upon battery operated alarms which are activated upon movement of the security container. Exemplary of such devices are those disclosed in U.S. Pat. Nos. 3,893,096 and 3,851,326. Typically, alarm type devices do not prevent physical movement of the containers and are generally ineffective in preventing theft of the containers.

Other types of devices for theft prevention embodying means for electrifying the security container have also been suggested. Frequently these devices are installed in the handle of the container and impart an electrical shock to the person gripping the handle. U.S. Pat. No. 1,288,909 discloses a device of the aforementioned character. Such devices are often ineffective because the shock is mild, or because the thief can transport the device while avoiding the handle portion.

Still other anti-theft devices have been suggested, which under theft condition, enable portions of the container, such as a handbag, to be heated to a very high temperature. A device of this character is disclosed in U.S. Pat. No. 4,162,695.

The apparatus of the present invention overcomes many of the drawbacks of the prior art anti-theft devices by providing means for automatically electrifying the exposed surfaces of a security container and for energizing an audio alarm by remotely activated switches and by switches sensing unauthorized movement and transport of the container.

SUMMARY OF THE INVENTION

It is an object of the present invention to provide a security container in which selected exterior surfaces thereof can be automatically electrified upon unauthorized movement or transport of the container.

Another object of the invention is to provide a security container of the aforementioned character in which the exterior surfaces of the container can be electrified by a remote transmitter, which transmits signals to a receiver amplifier carried by the container which, in turn, activates an electrical circuit adapted to electrically energize concealed conductors disposed proximate the exterior surfaces of the security container. The remote transmitter may be fixed or it may be a hand-held, portable transmitter. The fixed transmitter emits signals which activate the circuitry if the container is moved a predetermined distance relative to the position of the transmitter. The hand-held transmitter can be activated by the owner of the container at any appropriate time.

Another object of the invention is to provide a security container as described in the preceding paragraph in which the electrical circuit can also be energized by a switch mechanism adapted to sense a lifting movement of the container.

Another object of the invention is to provide a security container of the character described in which the electrical circuit can be energized by a switch mechanism normally held in an open position by a pull pin to which hand cuffs or other locking mechanisms can be affixed. If the security container is snatched from the owner, the pin will be pulled and the circuit will be automatically energized.

Still another object of the invention is to provide a security container of the class described which also embodies an audio alarm system that is automatically activated upon unauthorized transport or movement of the container.

A further object of the invention is to provide a security container of the type described in thee preceding paragraphs in which the electrification system, as well as the audio alarm system, is operated by a dry cell battery array carried by the security container.

Still another object of the invention is to provide a security container of the class described which is reliable in operation and is easy and inexpensive to manufacture.

DESCRIPTION OF THE INVENTION

Figure 1:
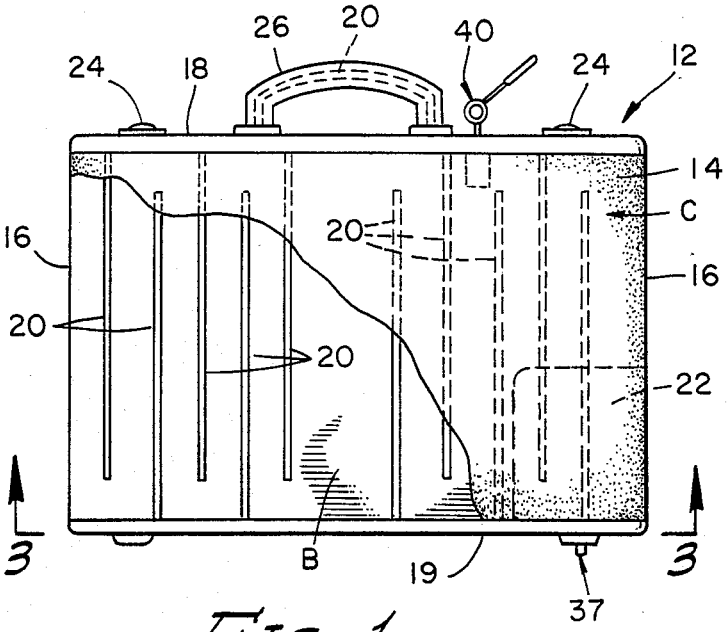
FIG. 1 is a side elevational view, partly broken away to show internal construction, of one form of security container of the present invention. In this embodiment of the invention, the security container takes the form of an attache case.

Referring to the drawings and particularly to FIGS. 1 through 5, one form of the security container of the invention is there shown and generally designated by the numeral 12. In the embodiment of the invention shown in the drawings, the security container takes the form of an attache case having interconnected side, end, top and bottom walls 14, 16, 18, and 19 respectively. Each of the side, end and top walls comprises a base wall, designated in FIGS. 1 and 5 by the letter B, and an outer covering designated by the letter C. The outer covering is affixed to the base wall B, by any suitable means such as bonding with adhesive. This outer covering may be cloth, vinyl, leather or any suitable covering material best suited for the end application of the security container.

Figure 5:
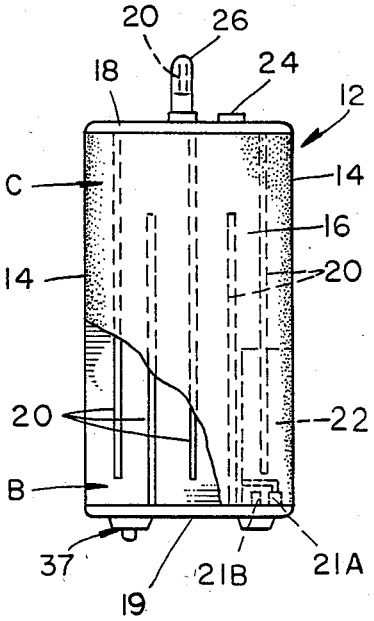
FIG. 5 is an end view of the security container partly broken away to show internal construction.
Figure 3:
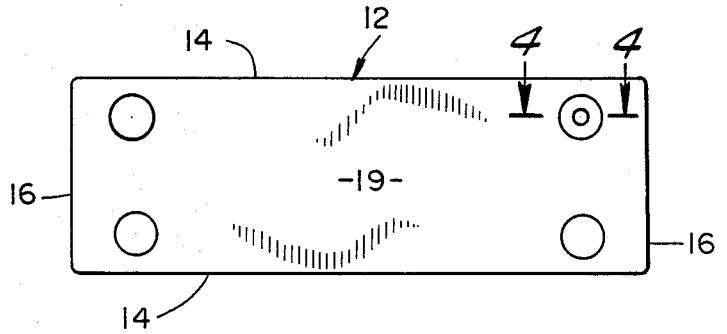
FIG. 3 is a bottom view of the security container taken along lines 3—3 of FIG. 1.

Disposed intermediate the base wall B and the outer covering C are a multiplicity of operatively interconnected electrically conductive wires 20. These wires 20 are best seen by referring to FIGS. 1 and 5 wherein the wires are shown by solid lines in the broken away portions of the drawings. Wires 20 are interconnected with the electrical circuit of the invention by means of terminals 21A and 21B located interiorly of the case (FIG. 5).

The interior of the security container, or attache case, includes an internal, closed compartment 22 located proximate one corner of the case. Mounted within compartment 22 are terminals 21A and 21B, the source of electric current and the electrical circuitry of the invention, the character of which will presently be discussed. The remainder of the interior of the security container is adapted to receive valuables, documents or other articles desired to be maintained within a secure environment.

The security container of the present invention may take various forms other than the attache case depicted in the drawings, including handbags, suitcases, lockboxes, safes and the like. However, depiction of the security container in the form of an attache case clearly illustrates a popular application of the present invention.

Figure 2:
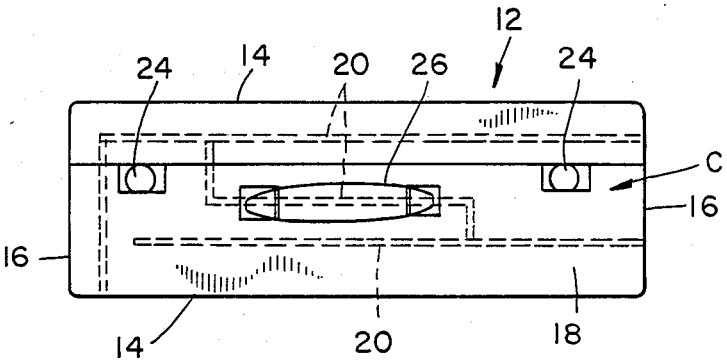
FIG. 2 is a top view of the security container.

The attache case illustrated in the drawings is constructed much like a standard attache case having means for gaining access to the interior of the case. In this instance, one side of the case is hingeable connected to the bottom wall and is moveable from the closed position illustrated in the drawings to a open position (not shown) wherein articles may conveniently be placed within the attache case. The openable side portion is preferably maintained in a closed and latched position by means of mechanical latching mechanisms generally designated in the drawings by the numeral 24. Such latching mechanisms are readily available and are well known to those skill in the art. The attache case is also provided with a pivotably connected carrying handle 26 of standard construction. However, as indicated in FIGS. 1, 2 and 5 conductive wires 20 are also provided within the handle assembly and are interconnected with the electrical circuitry so as to be energized upon unauthorized transport of the container.

Figure 7A:
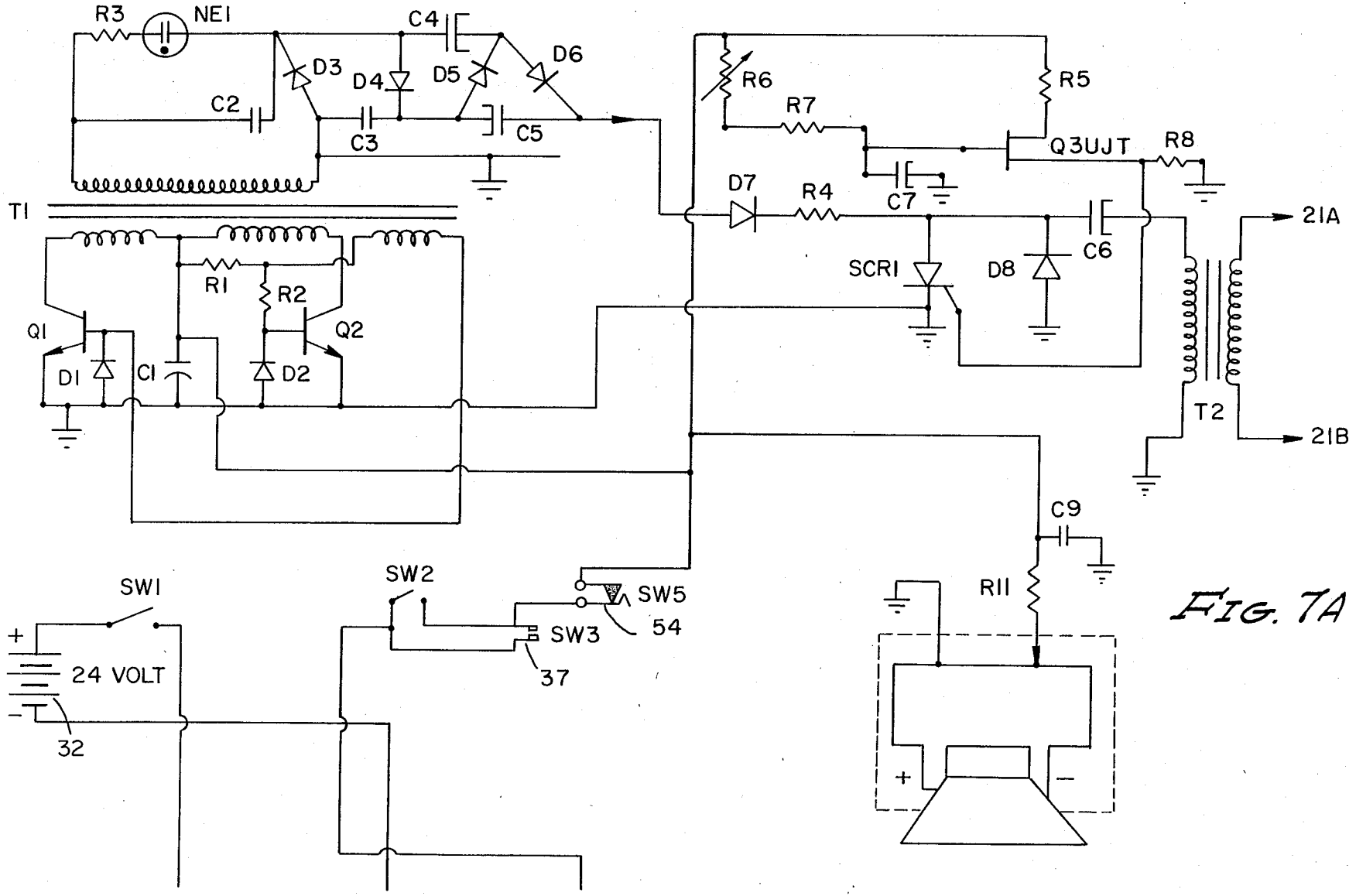
FIGS. 7A and 7B are generally schematic views of one form of the electrical circuity of the apparatus of the invention.
Figure 7B:
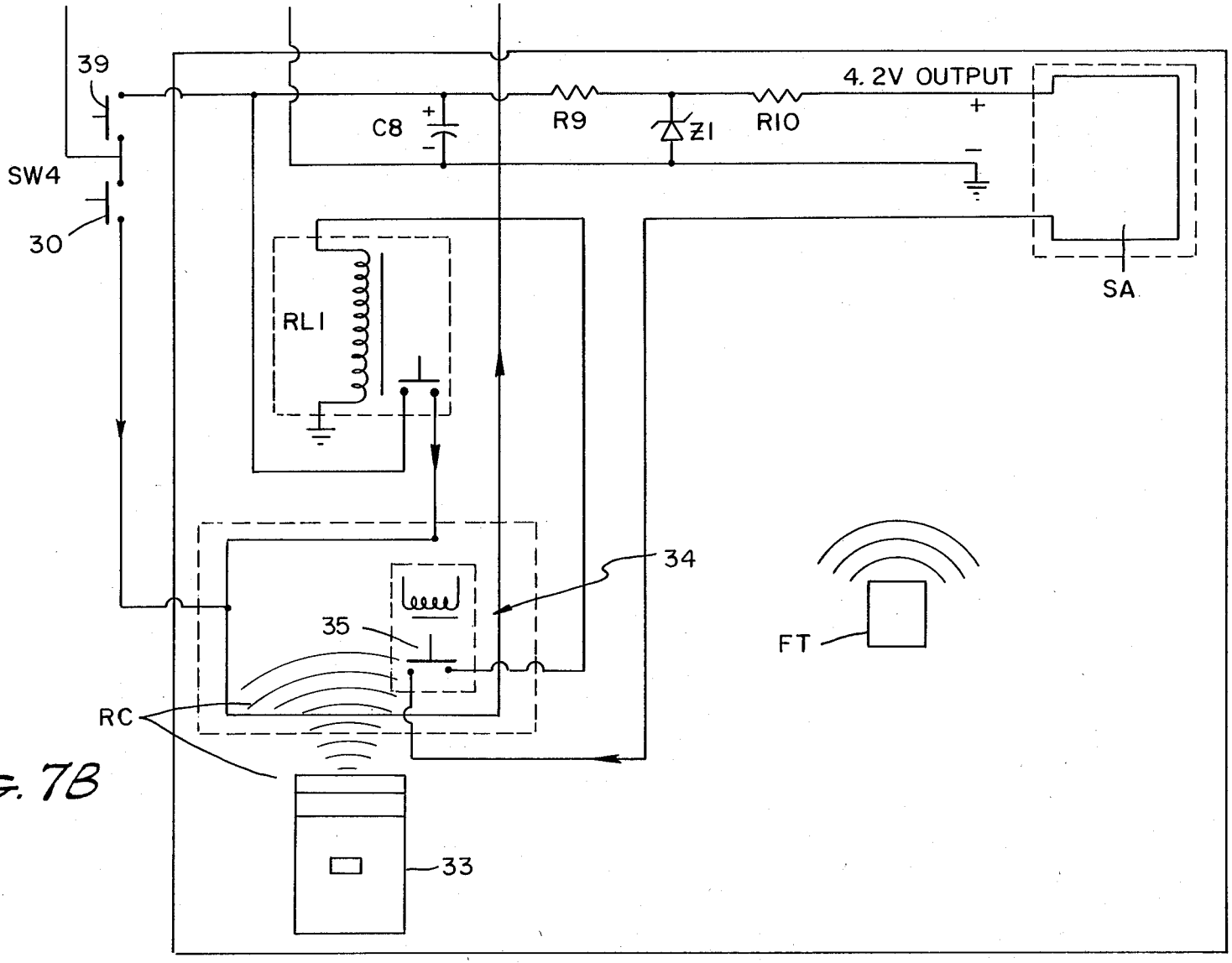

The circuit means of the invention for selectively interconnecting the source of electrical current, in this instance one or more dry cell batteries 32, with the electrical wires or conductors 20, is illustrated in detail in FIG. 7A and 7B. Referring particularly to these Figures, the circuit means of the present form of the invention comprises a first switch means SW4, including first and second switches 30 and 39 which are operatively associated with the battery array 32 and the electrical conductors 20. A remote control unit RC, which includes a remotely located hand-held transmitter, identified in FIG. 7B by the numeral 33, is provided for transmitting a signal in the direction of the security container. A receiver 34, which also forms a part of the remote control unit, is carried within compartment 22 of the housing for receiving a signal transmitted by the transmitter to interconnect the battery and the wires 20 via the circuit means. As previously mentioned, upon receipt by the receiver 34 of a signal from the remote control unit, the wires or conductors 20 will be electrically energized so that one being in contact with the handle or walls of the attache case will receive an electrical shock of a nonlethal, but nevertheless, substantial magnitude.

The transmitter and receiver are of standard construction and are readily commercially available. A suitable transmitter and receiver combination is distributed by Eagle Electronics of Glendale, Calif. under the name and style "Safe House, Wireless Panic Control", Model No. 49-536. This combination has proven quite satisfactory for use in connection with the apparatus of the invention. The manner of interconnection of the transmitter and the receiver within the circuit mean of the invention will presently be described.

A second fixedly located transmitter, designated in FIG. 7B as FT, also comprises a part of the circuit means of the invention. This transmitter interfaces with the receiver designated in FIG. 7B as SA. As will be described further hereinafter, when second switch 39 of SW4 is closed, receiver SA functions to cause energization of the conductors 20 upon the security containers being moved a predetermined distance from the location of the fixed transmitter. Receiver SA and transmitter FT are commercially available and are of a construction well known to those skilled in the art. A suitable receiver and transmitter marketed under the name and style "Sensor Alert" can be obtained from the Nuvations Company of San Francisco, Calif.

In the present embodiment of the invention, the security container also includes a second switch means, comprising a mechanical switch assembly 37 (FIG. 4) which, in this instance, is carried by the bottom, surface engaging wall 20 of the housing of the security container, or attache case 12. Mechanical switch 37 is associated with the electrical conductors, or wires 20, and the source of electrical current in the manner depicted in the circuit drawing in FIG. 7A.

Figure 4:
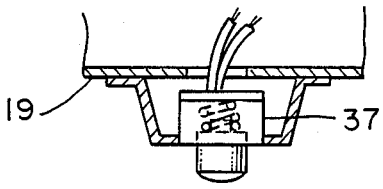
FIG. 4 is an enlarged fragmentary, cross-sectional view taken along lines 4—4 of FIG. 3.

In the form of the invention shown in FIG. 4, the mechanical switch 37 is moveable from a first open position, when the bottom of the attache case or housing is in contact with a rigid surface, into a second closed position when the bottom of the housing or attache case is separated from the rigid surface. With this construction, when the switch is moved into the second closed position, the electrical conductors will, in a manner presently to be described, be interconnected with the source of electrical current, or the battery 32, causing an electrical current to flow through the wires 20 in the same manner as accomplished through the use of a receiver and transmitter combination previously discussed. Switch assembly 37 is also of standard construction and is readily commercial available. This assembly may take several forms but preferably is provided in the form of a compact and inexpensive bias-operated micro switch.

Figure 6:
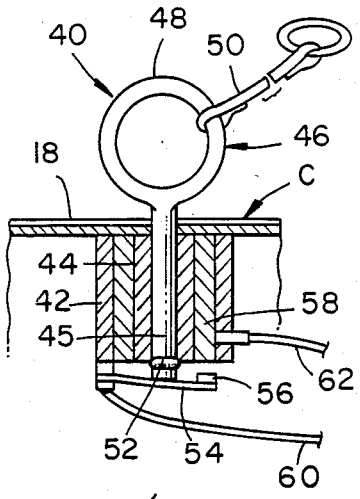
FIG. 6 is an enlarged fragmentary, cross-sectional view of the pull-pin actuation mechanism of the invention.

The security container of the invention further includes a pull-pin mechanism for energization of the conductors 20. The pull-pin mechanism of the instant form of the invention is shown in FIG. 6 and is generally designated by the numeral 40. Mechanism 40 comprises a tubular housing 42 which is carried by top wall 18. Disposed concentrically within housing 42 is a tubular member 44 which is adapted to closely receive the shank 45 of a pull-pin 46. Shank 45 which is constructed from an electrically non-conductive material, protrudes through top wall 18 and carries at its upper extremity a ring shaped member 48. Member 48 is contructed so that a chain, or cable, 50 can be readily connected thereto. Cable 50 can, in turn, be connected to handcuffs, ring cuffs, or other types of locking mechanisms.

Pull-pin 46 is releasably held in its fully inserted position within member 44, as illustrated in FIG. 6, by a ring shaped member, such as an elastomeric O-ring 52. In its fully inserted position, the lower end of shank 45 engages an electrical contact 54 which forms a part of the third switch means of the invention. Contact 54 is here shown as a yieldably deformable metal strip, one end of which is affixed to housing 40 and the other end of which is movable into engagement with an electrical contact 56 upon removal of the pull-pin. Contact 56, which also forms a part of the third switch means of the invention, is located on the lower surface of a tubular member 58 which is disposed intermediate members 40 and 44. Wires 60 and 62 interconnect contacts 54 and 56 with the electrical circuitry of the invention.

With the construction shown in FIG. 6, the pull-pin can, for example, be connected with handcuffs worn by a courier carrying the attache case. If a thief snatches the case, pull-pin 46 will be pulled from member 44 and contacts 54 and 56 will close due to the spring action of contact 54. In a manner presently to be described, this will energize the conductors 20 as well as activating the audio means or audio alarm device of the invention now to be described.

The audio means of the invention is carried within the security container and functions to emit a loud audio signal when the switching means of the invention are moved into the closed position. Several types of audio devices can be used in connection with the circuitry of the present invention. A commercially available audio device sold under the name and style "Piezo Siren", Model No. P250, has proved satisfactory for use in connection with the attache case illustrated in the drawings. However, any other suitable type of commercially available audio signaling device could be used in place of the Piezo Siren.

Turning now particularly to FIGS. 7A and 7B, the components of the circuit means of the invention there shown and their values are as follows:

| Component | Value | Component | Value |
|---|---|---|---|
| R-1 | 2.2 K, ¼ watt | D-3 | IN 400 Z diode 100 V |
| R-2 | 220 ohm, 1 watt | D-4 | IN 400 Z diode, 100 V |
| R-3 | 390K, ¼ watt | D-5 | IN400 7 diode, 1000 V |
| R-4 | 220 ohm, ¼ watt | D-6 | IN 4007 diode, 1000 V |
| R-5 | 100 ohm, ¼ watt | D-7 | IN 4007 diode, 1000 V |
| R-6 | 500K trim pot vertical resistor | D-8 | IN 4007 diode, 1000 V |
| R-7 | 22K ¼ watt | Z-1 | Zener 6.2 V |
| R-8 | 10K ¼ watt | Q-1 | D40D5NPN Power Transistor |
| R-9 | 1 ohm, 1 watt | Q-2 | D40D5NPN Power Transistor |
| R-10 | 47 ohms, 1 watt | Q-3 | 2N2646 SCR |
| R-11 | 47 ohms, 1 watt | NE-1 | NE 51 with leads |
| C-1 | 10MF, 25V | T-1 | Typel, 400 V Inverer Transformer |
| C-2 | 0.1MF, 400 V paper | T-2 | Special high voltage Pulse Transformer |
| C-3 | 0.1MF, 400V paper | SCR-1 | 2N443 SCR |
| C-4 | 0.1MF, 400V paper | SW-1 | Main on/off switch |
| C-5 | 0.1MF, 400V paper | SW-2 | Control Switch |

-continued

| Component | Value | Component | Value |
|---|---|---|---|
| C-6 | 12MF, 400 V spec. plus discharge | SW-3 | Micro-switch (lift actuated) |
| C-7 | 1.0MF, 25 V electro litic | SW-4 | Selector, 2 position switch |
| C-8 | 47MF, 50 V | SW-5 | Pull-pin switch |
| C-9 | 47MF, 50 V | HS | Remote Transmitter (Handset) |
| D-1 | 1N400 Z diode, 100 V | RL1 | Relay Switching |
| D-2 | 1N400 Z diode, 100 V | | |

The operation of the circuit means and the interaction of the various components of the circuit of the present embodiment of the invention is as follows: The current generated by batteries 32, which, for example, can be sixteen, 1.5 volt "AA" rechargeable dry cell batteries, flows through switch 1 (SW1) in closed position ("off" in open position, as shown in FIG. 7A) to the selector switch SW4. SW1 is the main on/off switch of the circuit and in the "off" position disables the apparatus. SW4 comprises a part of the first switch means of the form of the invention shown in the drawings. At SW4 there are two possibilities; namely to operate through the sensor alert unit SA or through the previously mentioned remote control unit RC.

To operate through remote control unit, switch 30 of SW4 is moved to the closed position so that the current will flow via first switch 30 of SW4 directly to the printed circuit board of the receiver 34 which itself will control the on/off switching in conjunction with remote transmitter or a handset 33. When the remote transmitter 33 is activated, the receiver 34 will receive the signal sent by the transmitter 33 and the current will flow to switch No. 2 (SW2).

When switch SW2 is open, as shown in FIG. 7A, switch SW3 is operable. In other words, when switch SW2 is closed, switch SW3 is bypassed and current will flow directly to switch SW5 of the pull-pin assembly 40, which comprises part of the third switch means of the invention, and thence to the main circuit board in a manner presently to be described.

To operate through sensor alert unit SA, switch 39 of SW4 is moved to the closed position so that the current will flow via switch 39 of SW4 to R9 and C8, being current pulsed via the Z1 semi-conductor to obtain 6.2 volts. This current operates as a voltage drop power supply. R10 supplies 4.2 volt current to sensor alert receiver SA. When the sensor alert receiver receives a signal from a transmitter FT, which is preferably located at a distance of 15–30 feet, it activates the receiver 34 which triggers the built-in relay sending low voltage to RL1 which in turn activates the complete circuit of remote receiver amplifier by sending current to SW2.

Switch 3 (SW3), also identified in FIG. 7A by the numeral 37, comprises a part of the previously identified second switch means of the invention. Preferably switch 37 is a simple, but reliable microswitch capable of being readily mounted within the bottom wall of the attache case in the manner shown in FIGS. 3 and 5.

Referring particularly to FIG. 7A, the circuit means of the invention comprises a power section, shown generally at the right-hand side of FIG. 7A and a capacitor discharge section shown generally at the left-hand side of FIG. 7A. The power section is operated by the source of electrical power, or batteries 32, and comprises transisters Q1 and Q2 which alternately switch current flow in the primary of transformer T1 to induce a high voltage square wave at the secondary of the transformer. Diodes D1 and D2 provide the return path for the base current flow in the conducting transister obtained from the feed back winding on transformer T1. Resistor R2 limits the space current to a value necessary to cause saturation of the transisters. Resistor R1 causes a temporary positive imbalance condition to start the switching action.

A voltage multiplier consisting of multiplier diodes D3, D4, D5 and D6 and capacitors C2, C3, C4 and C5 develops a high voltage of at least approximately 1,500 to 2000 volts.

The switch of the pull-pin mechanism 40 is identified in FIG. 7A as SW5 and is shown in the closed position. In operating the pull-pin mechanism the following steps must be taken. The pull-pin must be fully inserted into the pull-pin mechanism as shown in FIG. 6. Next the remote control RC must be activated and switch SW2 closed. When the pull-pin 48 is pulled, current will then be permitted to flow to the main circuit presently to be described.

The capacitor discharge section of the circuit section comprises a high-voltage pulse transformer T2 which is current pulsed via SCR1 shorting a charged capacitor C6 across its primary. C6 and the primary inductance of T2 provides a ringing wave whose negative overshoot commutates SCR1 to turn off. It is important that this primary inductance be sufficient that when combined with capacitor C6 a ringing frequency results having a period considerably larger than the required commutation turn-off time of the SCR1. Diode D8 provides energy recovery of the negative overshoot component of this discharge pulse.

It is to be noted that transformer T2 induces a very high voltage pulse in its secondary with a high instantaneous peak current. Diode D7 and R4 limit the DC current to the SCR1 and prevent DC lock on, which also provides a high impedance to the negative turn off pulse. SCR1 is triggered by the UJT pulse timing circuit comprising Q3.

The pulse repetition rate is determined by capacitor C7 and the charging resistor R6. SCR1 switch rate can be adjusted from 1 to 10 PPS. Higher pulse repetition rates may have a tendency to overload the inverter power supply so that it will be unable to concurrently supply the current necessary to successfully charge C6. The voltage output of T2 is well over 25,000 volts.

Considering now the main circuit board of the circuit, once the current reaches the main circuit board, two events will occur, first, the siren driver amplifier will be activated which will send a very loud high pitch noise of about 110 dB. Second, the current will pass through the power supply, through the transformer "T1" to the oscillator amplifier, reaching the convertor DC-to-AC, and later to "T2" transformer, which is the output pulse transformer. Through "T2" very high voltage current is generated which flows to the outer wire of the "T2" transformer. The two points of the outer wires are connected to terminals 21A and 21B on the attache case. These terminals are, in turn, connected to the circuit carried within compartment 22 of the attache case.

Having now described the invention in detail in accordance with the requirements of the patent statutes, those skilled in this art will have no difficulty in making changes and modification in the individual parts or their relative assembly in order to meet specific requirements or conditions. Such changes and modifications may be made without departing from the scope and spirit of the invention, as set forth in the following claims.

I claim:

1. A security container, comprising:

(a) a housing having exterior walls including a surface-engaging wall, said exterior walls defining an interior compartment;

(b) a means for gaining access to said interior compartment;

(c) a multiplicity of operatively interconnected electrical conductors disposed proximate said exterior walls of said housing;

(d) a source of electrical current carried by said housing;

(e) a first switch means carried by said housing for selectively interconnecting said source of electrical current with said multiplicity of electrical conductors, said first switch means comprising first and second mechanically operated switches;

(f) a remotely located transmitter means for transmitting an electrical signal in the direction of said housing;

(g) a receiver means for receiving said signal from said transmitter means to energize said electrical conductors when the appropriate one of said first and second mechanically operated switches is closed; and (h) second switch means comprising a normally open mechanical switch carried by said surface-engaging wall and closing if said surface-engaging wall is moved away from the surface with which it is in engagement to energize said electrical conductors.

2. A security container as defined in claim 1 in which said transmitter means comprises a portable hand-operated transmitter and in which, when a first one of said first and second mechanically operated switches is closed, said receiver means energizes said electrical conductors upon receipt of a signal from said portable hand-operated transmitter.

3. A security container as defined in claim 1 in which said transmitter means comprises a fixed transmitter and in which when the other of said first and second mechanically operated switches is closed, said receiver means energizes said electrical conductors upon said container's being moved from said fixed transmitter a predetermined distance.

4. A security container as defined in claim 1 in which said exterior walls comprise spaced apart side walls, spaced apart end walls and a top wall spaced apart from said surface-engaging wall, each of said side, end and top walls comprising a first generally planar base surface and a second relatively thin outer covering spaced apart from said base surface, said electrical conductors being disposed intermediate said base surface and said outer covering, whereby upon energization of said conductors, one contacting said outer covering will receive an electrical shock.

5. A security container as defined in claim 4, further including audio alarm means carried by said housing and a operatively associated with said first and second switch means for emitting a loud audio signal upon the closing of said first and second switches.

6. A security container as defined in claim 5 in which said source of electrical current comprises a battery removeably carried by said housing.

7. A security container as defined in claim 5 in which said security container includes a handle having electrical conductors carried thereby, said conductors being selectively interconnected with said source of electrical current by said first and second switch means.

8. An attache case, comprising:

(a) a housing having interconnected, side, end, top and bottom walls, each said side, end and top wall comprising a base wall and an outer covering affixed to said base wall;

(b) a multiplicity of interconnected, electrically conductive wires disposed intermediate said base wall and said outer covering;

(c) a battery carried by said housing;

(d) circuit means for selectively interconnecting said battery and said wires, said circuit means comprising;

(i) first switch means, operationally associated with said battery and said wires, said first switch means comprising first and second mechanically operated switches, a remotely located transmitter for transmitting a signal in the direction of said housing, and a receiver carried by said housing for receiving said signal from said transmitter to interconnect said battery and said wires when the appropriate one of said first and second mechanically operated switches is closed;

(ii) a second switch means, including a normally open mechanical switch carried by said bottom wall of said housing, said switch being operatively associated with said wires and said battery and being movable from a first open position when said bottom of said housing is in contact with a rigid surface into a second close position when said bottom of said housing is separated from said rigid surface, whereby said battery and said wires will be interconnected causing an electrical current to flow through said wires; and (iii) a third switch means including a switch carried by said top wall of said housing, said switch having a pull pin for holding said switch in an open position and being operatively associated with said wires and said battery, said switch being movable into a closed position upon removal of said pull pin; and (e) audio means carried by said housing and operatively associated with said circuit means for emitting an audio signal upon the closing of any one of said first, second and third switch means.

* * * * *